US007014514B2

(12) United States Patent
Zahnen

(10) Patent No.: US 7,014,514 B2
(45) Date of Patent: Mar. 21, 2006

(54) SLIP-FIT CONNECTOR COMPATIBLE WITH DIFFERENT SIZE TRANSFORMER STUDS AND RELATED METHODS

(75) Inventor: James L. Zahnen, Ormond Beach, FL (US)

(73) Assignee: Homac Mfg. Company, Ormond Beach, FL (US)

( * ) Notice: Subject to any disclaimer, the term of this patent is extended or adjusted under 35 U.S.C. 154(b) by 552 days.

(21) Appl. No.: 10/263,275

(22) Filed: Oct. 2, 2002

(65) Prior Publication Data

US 2004/0067697 A1 Apr. 8, 2004

(51) Int. Cl.
*H01R 11/09* (2006.01)

(52) U.S. Cl. ..... 439/798

(58) Field of Classification Search ..... 439/795, 439/796, 797, 798, 799, 800, 801, 803
See application file for complete search history.

(56) References Cited

U.S. PATENT DOCUMENTS

| | | | | |
|---|---|---|---|---|
| 4,214,806 A | | 7/1980 | Kraft | 439/620 |
| 4,382,651 A | | 5/1983 | Klosin et al. | 439/359 |
| D309,664 S | | 7/1990 | McGrane | D13/146 |
| D320,381 S | | 10/1991 | McGrane | D13/147 |
| 5,690,516 A | | 11/1997 | Fillinger | 439/798 |
| 5,848,913 A | * | 12/1998 | Ashcraft | 439/521 |
| 5,931,708 A | * | 8/1999 | Annas et al. | 439/798 |
| 6,579,131 B1 | * | 6/2003 | Ashcraft et al. | 439/798 |

OTHER PUBLICATIONS

Homac Zeebar Compact online; Disconnectable Secondary Transformer Connector; pp. 13-14, no date.
Blackburn Secondary Products online; Transformer Stud Connector; pp 1/3-1/21 by Thomas & Betts., no date.
CMC/ESP Utility Products, "*Space-Saver Stud-Mount Transformer Connector*", Jun. 2001, p. B-7.

* cited by examiner

*Primary Examiner*—Hae Moon Hyeon
(74) *Attorney, Agent, or Firm*—Allen, Dyer, Doppelt, Milbrath & Gilchrist, P.A.

(57) ABSTRACT

A slip-fit electrical connector compatible with different size threaded transformer studs includes a body having a plurality of transverse conductor receiving passageways, and intersecting conductor fastener receiving passageways. The body also has a multi-size transformer stud receiving passageway extending longitudinally inwardly from an end thereof, and at least one stud fastener receiving passageway intersecting the multi-size transformer stud receiving passageway. The multi-size transformer stud receiving passageway may be defined by an arcuate bottom, and a plurality of successively larger threaded stud landings with a lowermost threaded stud landing being bifurcated by the arcuate bottom. Each successive threaded stud landing may be bifurcated by a prior threaded stud landing. The threaded stud landings are for different size threaded transformer studs to conveniently and reliably fasten the transformer stud and connector together.

36 Claims, 7 Drawing Sheets

SLIP-FIT CONNECTOR COMPATIBLE WITH DIFFERENT SIZE TRANSFORMER STUDS AND RELATED METHODS

FIELD OF THE INVENTION

The present invention relates to the field of electrical connectors, and, more particularly, to slip-fit electrical connectors for electrical power transformers and associated methods.

BACKGROUND OF THE INVENTION

In an electrical power distribution system, a transformer is commonly used to step down a higher voltage to a lower voltage more suitable for supplying customer electrical loads. A transformer typically includes an output conductor in the form of a threaded stud that, in turn, is connected to a plurality of individual electrical conductors by a transformer stud connector. A transformer stud connector may be connected to the threaded transformer stud using either a screwed on connection or a more convenient slip-fit connection.

A typical screwed on connector includes a threaded opening extending into the connector body. A lock nut is typically used to lock the connector and stud together. The connector body also typically has a plurality of conductor receiving passageways therein, and corresponding fastener receiving passageways intersecting the conductor receiving passageways. Accordingly, a conductor can be inserted into the conductor receiving passageway and secured therein by tightening a corresponding fastener.

A transformer connector using a threaded connection is also disclosed in U.S. Pat. No. 4,382,651 to Klosin et al. The connector includes a body having a threaded transformer stud receiving passageway extending longitudinally therein for receiving the threaded transformer stud. The transformer stud connector is screwed onto the threaded stud and locked into place with the tapered end of a conical screw that bears against the chamfer of the threaded stud.

Another transformer stud connector is disclosed in U.S. Design Pat. No. 309,664 to McGrane. The connector includes two generally rectangular body portions joined together in offset relation. A different sized stud receiving passageway is formed into each of the body portions.

A slip-fit transformer connector is illustrated in U.S. Pat. No. 4,214,806 to Kraft. The Kraft transformer connector includes a connector body, a transformer stud receiving passageway extending into the end of the body, and a stud fastener for fastening the transformer stud within the stud receiving passageway. A U-shaped groove is provided along the bottom of the transformer stud receiving passageway. The U-shaped groove, in combination with the fastener, provides three areas of contact with the transformer stud. This transformer stud connector, however, accommodates only one transformer stud size.

Another slip-fit transformer connector is illustrated in U.S. Pat. No. 5,690,516 to Fillinger. This transformer connector includes a transformer stud receiving passageway defined by a first smooth passageway and a smaller threaded passageway below the first smooth passageway. The threaded stud is slipped into the transformer stud receiving passageway and locked into place by a stud fastener. The shape and threads on the bottom exactly match the threads on the threaded stud. Accordingly, this connector is adapted to receive only one transformer stud size.

Another stud connector is offered by CMC/ESP Utility Products of Hamilton, Ohio under the designation TYPE SHB (quick Disconnect) that includes a stud receiving passageway having different sized portions to accommodate different sized transformer study. More particularly, the stud receiving passageway includes a small threaded bottom, a larger threaded landing above the threaded bottom, and an enlarged smooth upper portion. The threaded portions are sized to exactly accommodate the respective threaded studs. Moreover, the arrangement of the bottom threaded portion may permit undesired rocking or movement of the stud.

SUMMARY OF THE INVENTION

In view of the foregoing background, it is therefore an object of the present invention to provide a slip-fit transformer stud connector compatible with different size transformer studs, and that forms a strong and reliable connection.

This and other objects, features, and advantages of the present invention are provided by a slip-fit electrical connector compatible with different size threaded transformer studs including a body having a plurality of transverse conductor receiving passageways, and intersecting conductor fastener receiving passageways. The conductor fastener receiving passageways have conductor fasteners therein to secure the electrical connectors to the connector. The body may include a multi-size transformer stud receiving passageway extending inwardly from an end thereof, and at least one stud fastener receiving passageway therein intersecting the stud receiving passageway. The slip-fit electrical connector may further include at least one stud fastener in the at least one stud fastener receiving passageway.

Moreover, the multi-size transformer stud receiving passageway may be defined by an arcuate bottom, and a plurality of successively larger threaded stud landings. A lowermost threaded stud landing may be bifurcated by the arcuate bottom, and each successive threaded stud landing may be bifurcated by a prior threaded stud landing. Accordingly, the plurality of successively larger threaded stud landings are compatible with different size threaded transformer studs.

The bifurcated arrangement in combination with the one or more associated stud fasteners, provides effective triangular gripping of the transformer stud. In other words, the two edge regions defined by the bifurcation define the two lower contact or gripping areas to reduce rocking or loosening of the connection. To further enhance this three-region gripping feature, each threaded stud landing may be oversized for each respective different size transformer stud.

The multi-size transformer stud receiving passageway may further comprise an arcuate top merged with an uppermost threaded stud landing and connected to the stud fastener receiving passageway. The arcuate top may have a smooth surface and a first radius of curvature. The arcuate bottom may also have a smooth surface and a second radius of curvature.

The plurality of threaded stud landings may be two or more in number. The body may have a generally rectangular shape, and may comprise first and second generally rectangular portions connected in an offset arrangement to permit a larger number of connections to the transformer stud. The slip-fit electrical connector may comprise aluminum, for example.

A method aspect of the present invention is for making the slip-fit electrical connector. The method may comprise forming, in the body, a plurality of transverse conductor receiving passageways, and a plurality of conductor fastener receiving passageways intersecting respective transverse conductor receiving passageways. The method may further comprise forming, in the body, the multi-size transformer stud receiving passageway extending longitudinally inwardly from an end thereof, and at least one stud fastener receiving passageway intersecting the multi-size transformer stud receiving passageway. The multi-size transformer stud receiving passageway may be defined by an arcuate bottom, and a plurality of successively larger threaded stud landings with a lowermost threaded stud landing being bifurcated by the arcuate bottom, and each successive threaded stud landing being bifurcated by a prior threaded stud landing.

Another method aspect for making a slip-fit electrical connector for threaded transformer studs comprises forming, in a body, a plurality of transverse conductor receiving passageways, and a plurality of conductor fastener receiving passageways intersecting respective transverse conductor receiving passageways. The method may further comprise forming, in the body, a transformer stud receiving passageway extending inwardly from an end thereof by drilling at least one bore and forming at least one set of threads by helical interpolation.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternate embodiments.

Figure 1:
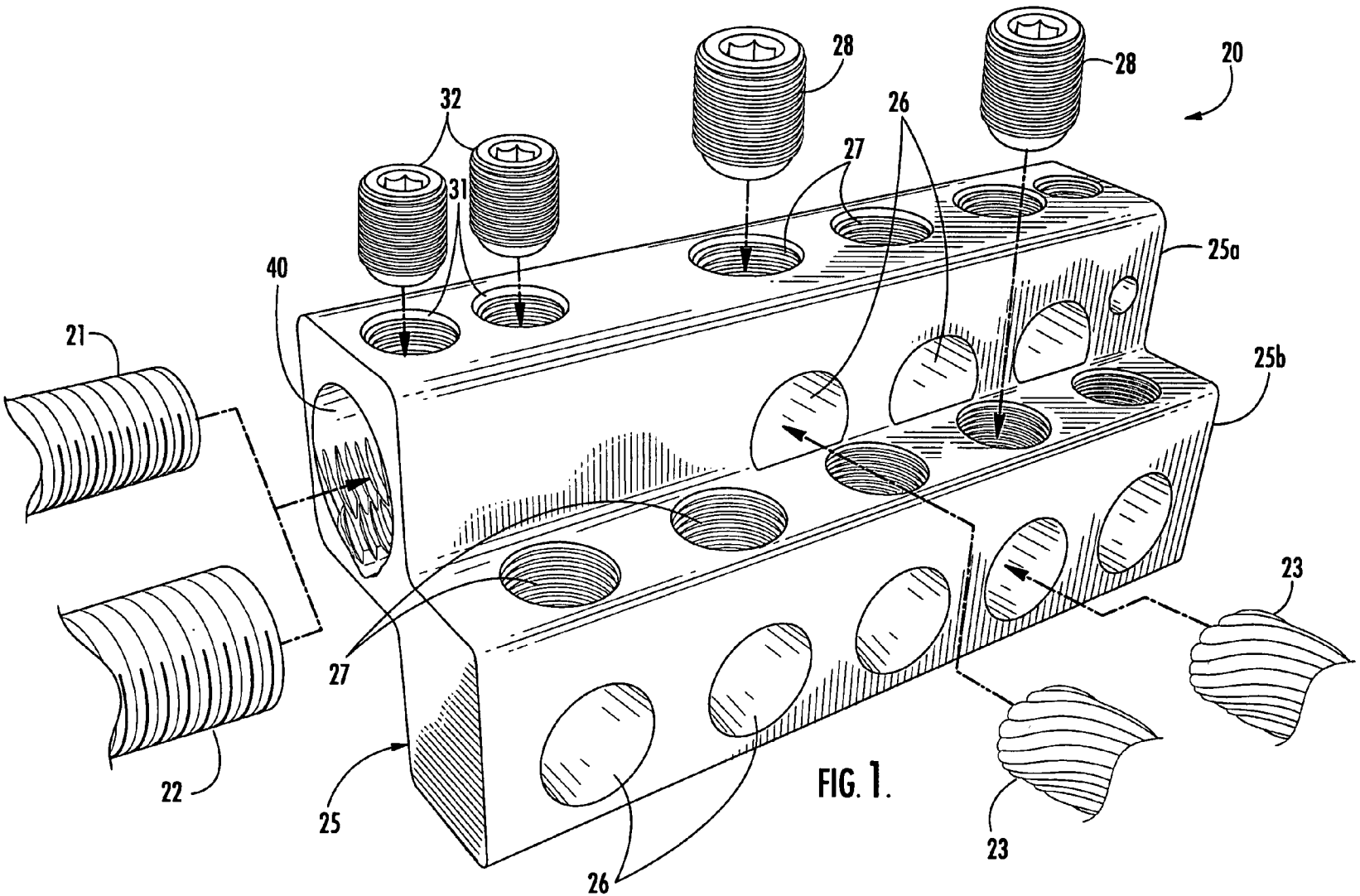
FIG. 1 is a perspective view of a slip-fit electrical connector compatible with different size threaded transformer studs according to the present invention.
Figure 2:
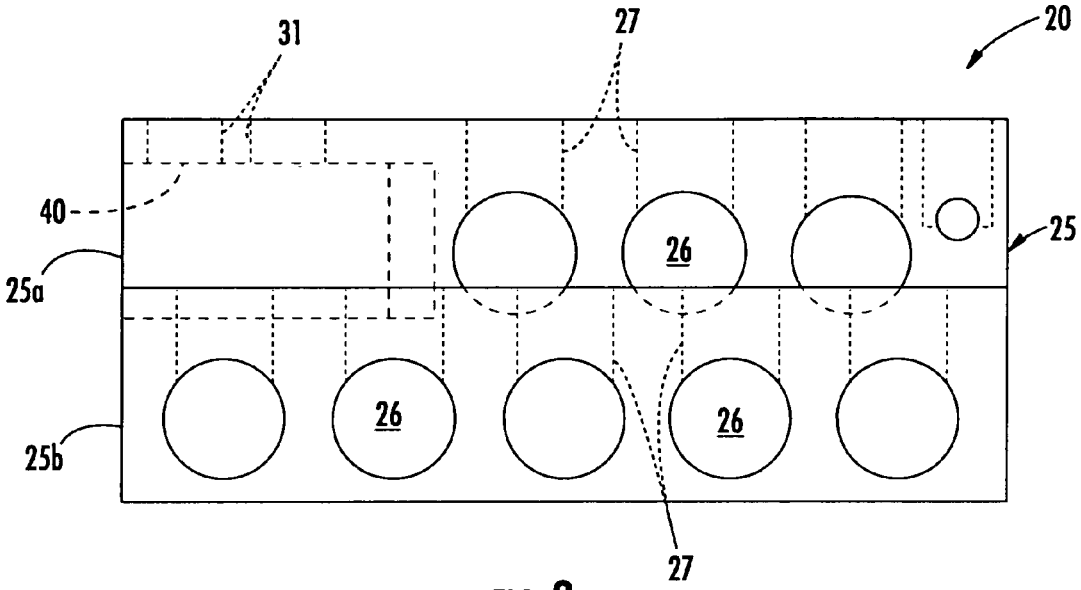
FIG. 2 is a side elevation view of the slip-fit electrical connector of FIG. 1.
Figure 3:
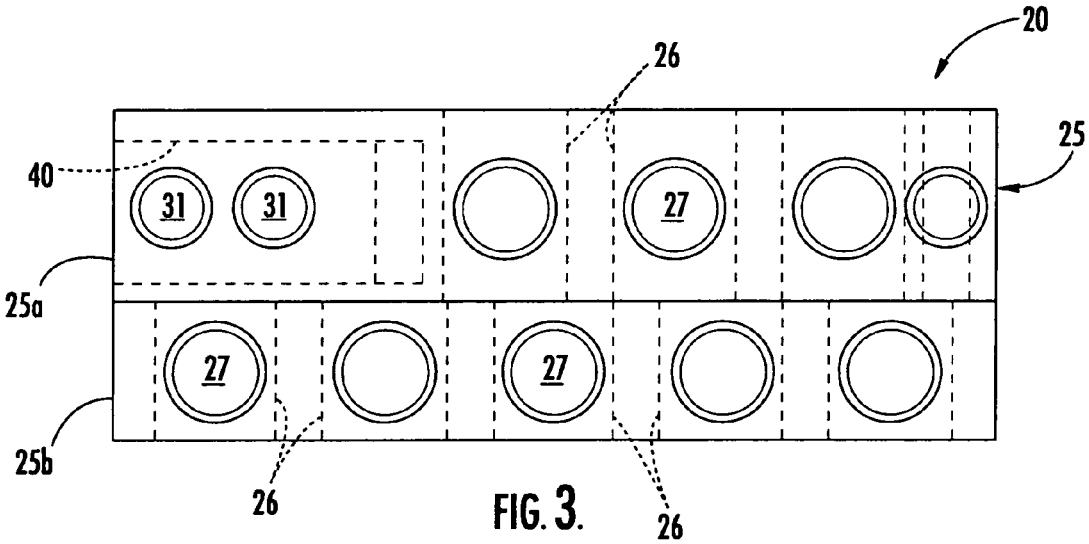
FIG. 3 is a top plan view of the slip-fit electrical connector of FIG. 1.
Figure 4:
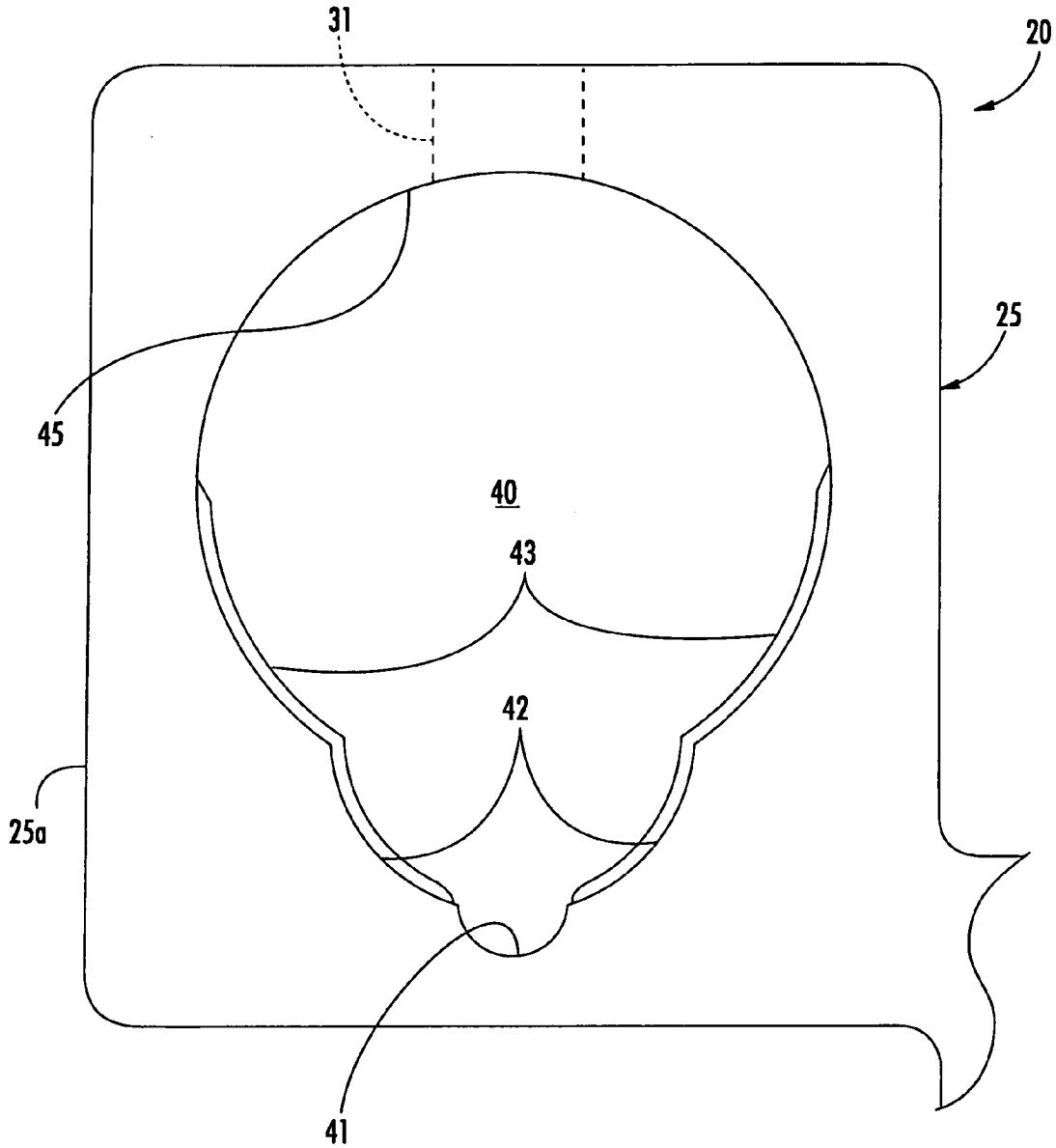
FIG. 4 is an enlarged end elevation view of a portion of the slip-fit electrical connector of FIG. 1.

Referring initially to FIGS. 1–4, a slip-fit electrical connector 20 compatible with different size threaded transformer studs 21, 22 is now described. As will be readily appreciated by those skilled in the art, some types of electrical distribution transformers include connectors in the form of threaded studs to which connections are made. Of course, transformer studs may come in different sizes, such as the smaller stud 21 and slightly larger stud 22 as illustrated in FIG. 1. Electrical conductors 23 (only two of which are shown for clarity) may be electrically connected to the transformer stud 21, 22 via the slip-fit electrical connector 20.

The slip-fit electrical connector 20 illustratively comprises an elongate body 25 having a plurality of transverse conductor receiving passageways 26 therein. The conductor receiving passageways 26 are generally cylindrical and may be smooth, for example. The elongate body 25 also has a plurality of conductor fastener receiving passageways 27 therein intersecting respective transverse conductor receiving passageways 26. The conductor fastener receiving passageways 27 are illustratively threaded to receive threaded fasteners, such as the illustrated hex-head screws 28. Other fasteners are also contemplated by the invention, and not all of the fasteners are shown in FIG. 1 for clarity.

The elongate body 25 of the electrical connector 20 illustratively has a multi-size transformer stud receiving passageway 40 that extends longitudinally inwardly from an end thereof. A pair of threaded stud fastener receiving passageways 31 are illustratively provided formed in the elongate body 25 and intersect the multi-size transformer stud receiving passageway 40. A pair of stud fasteners in the form of hex-head screws 32 are illustratively positioned in the stud fastener receiving passageways 31 for fastening the transformer stud 21, 22 in the multi-size transformer stud receiving passageway 40 as will be described in greater detail below. In other embodiments, only a single fastener may be used, or more than two fasteners may be used. Other types of fasteners may be used as well.

The elongate body 25 illustratively comprises first and second generally rectangular portions 25*a*, 25*b* connected in an offset arrangement. This permits a greater number of electrical conductors 23 to be connected to the transformer stud 21, 22. The body 25 may also be made of aluminum, although other conductive materials may be used as will be appreciated by those skilled in the art.

The multi-size transformer stud receiving passageway 40 is illustratively defined by an arcuate bottom 41, and a pair of successively larger threaded stud landings 42, 43. The arcuate bottom 41 illustratively includes a smooth surface. The lowermost threaded stud landing 42 is illustratively bifurcated by the arcuate bottom 41. Similarly, the uppermost threaded stud landing 43 is, in turn, bifurcated by the prior or lowermost landing 42. Of course, more than two such threaded landings may be provided so that each successive threaded stud landing, after the lowermost landing, is bifurcated by a prior threaded stud landing.

The multi-size transformer stud receiving passageway 40 further comprises an arcuate top 45 merged with the uppermost threaded stud landing 43 and connected in communication with the stud fastener receiving passageways 31. The arcuate top 45 illustratively has a smooth surface, but may have a threaded surface in other embodiments. The arcuate top 45 illustratively has a first and substantially larger radius of curvature than the second radius of curvature of the arcuate bottom 41.

Figure 5:
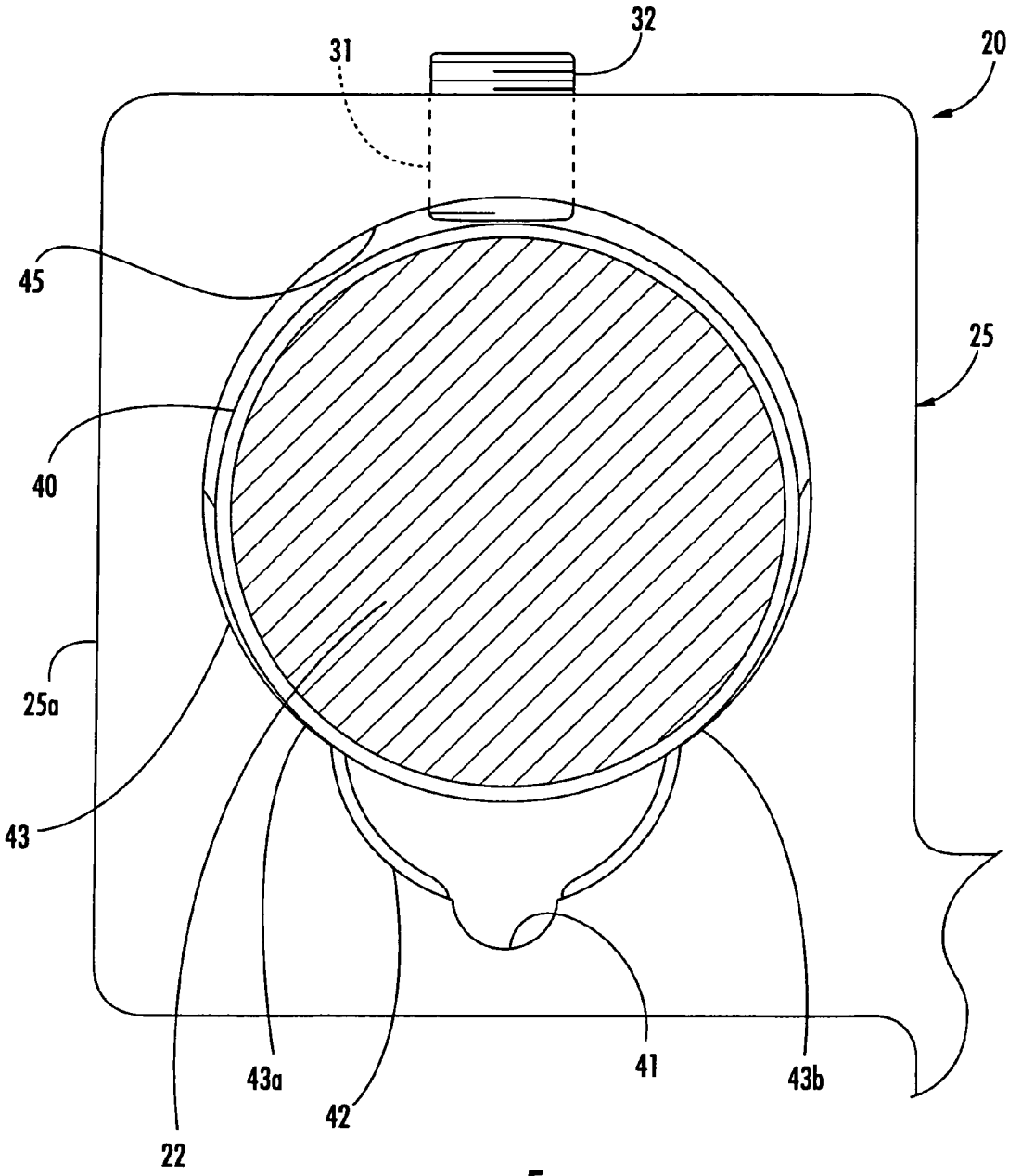
FIG. 5 is an enlarged end elevation view of a portion of the slip-fit electrical connector of FIG. 1 with a larger size transformer stud therein.

The threaded stud landings 42, 43 each has a radius of curvature to be compatible with different size threaded transformer studs 21, 22. Moreover, in some particularly advantageous embodiments, each threaded stud landing 42, 43 may have an oversized radius of curvature for each respective different size transformer stud 21, 22 as explained now with further reference to FIGS. 5 and 6. For the larger threaded stud 22 shown in FIG. 5, three contact areas or lines of contact are established based upon the oversized radius of curvature of the upper threaded landing 43. As is shown somewhat exaggerated in FIG. 5, bottom portions of the stud 22 contact the two opposing lower portions 43*a*, 43*b* of the upper threaded landing 43. The fasteners 32 from the top define the other part of a triangular contact arrangement. Accordingly, strong and reliable contact is made between the connector 20 and the transformer threaded stud 22 to prevent rocking and/or loosening of the connection. For a commonly sized stud 22 having a diameter of one inch, the radius of curvature of the upper threaded landing 43 may be 1 1/16 inches.

Figure 6:
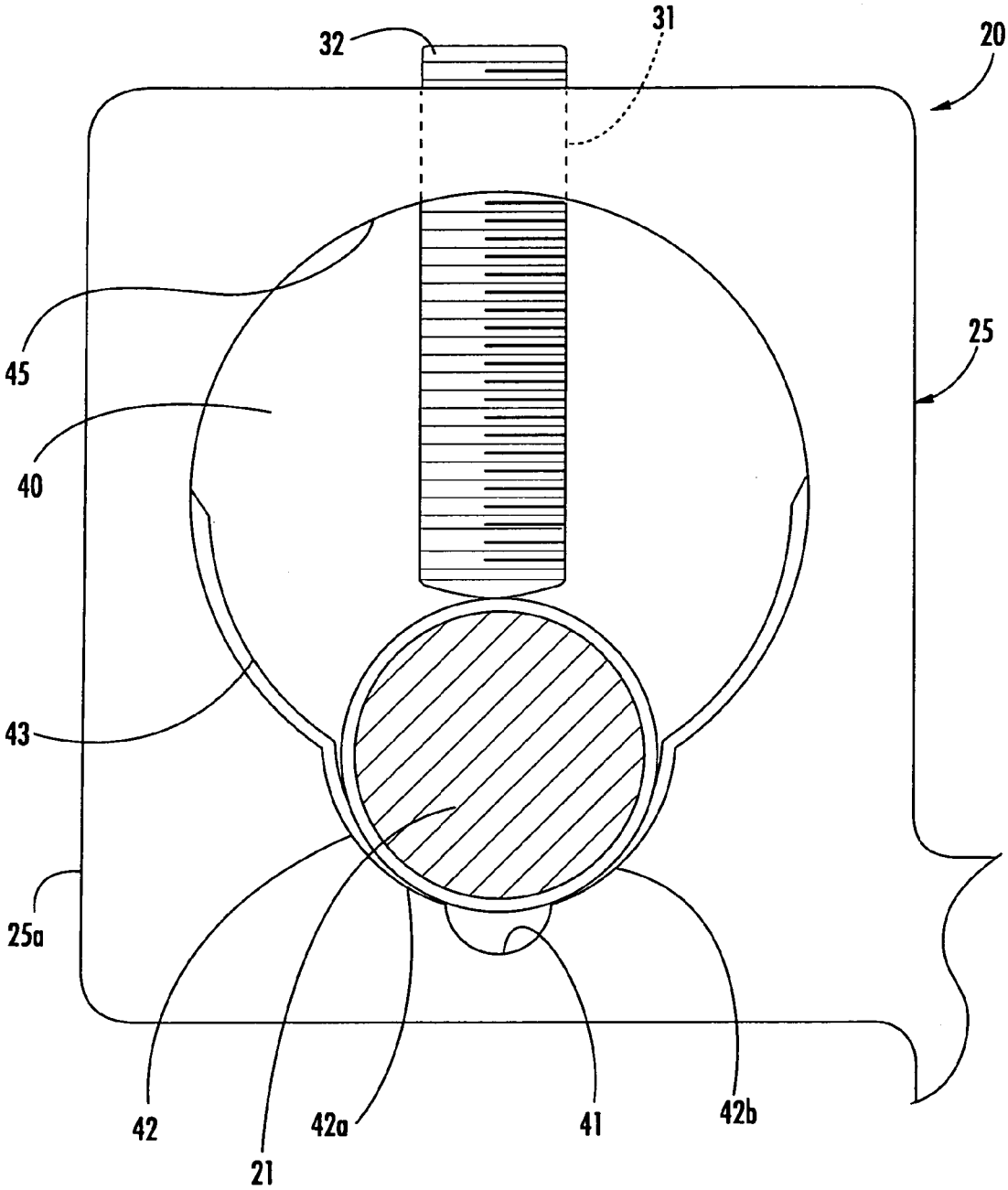
FIG. 6 is an enlarged end elevation view of a portion of the slip-fit electrical connector of FIG. 1 with a smaller size transformer stud therein.

Similarly, for the smaller size threaded transformer stud 21 as shown in FIG. 6, three contact areas or lines of contact are established based upon the oversized radius of curvature of the lower threaded landing 42. As is shown somewhat exaggerated, bottom portions of the stud 21 contact the two opposing lower portions 42*a*, 42*b* of the lower threaded landing 42. The fasteners 32 from the top define the other part of a triangular contact arrangement. Again, this arrangement provides strong and reliable contact made between the connector 20 and the transformer threaded stud 21 to prevent rocking and/or loosening of the connection during installation or over its service life. For a common 5/8 inch stud 21, the radius of the lower threaded landing may be 11/16 inches.

Figures 7, 8, 9:
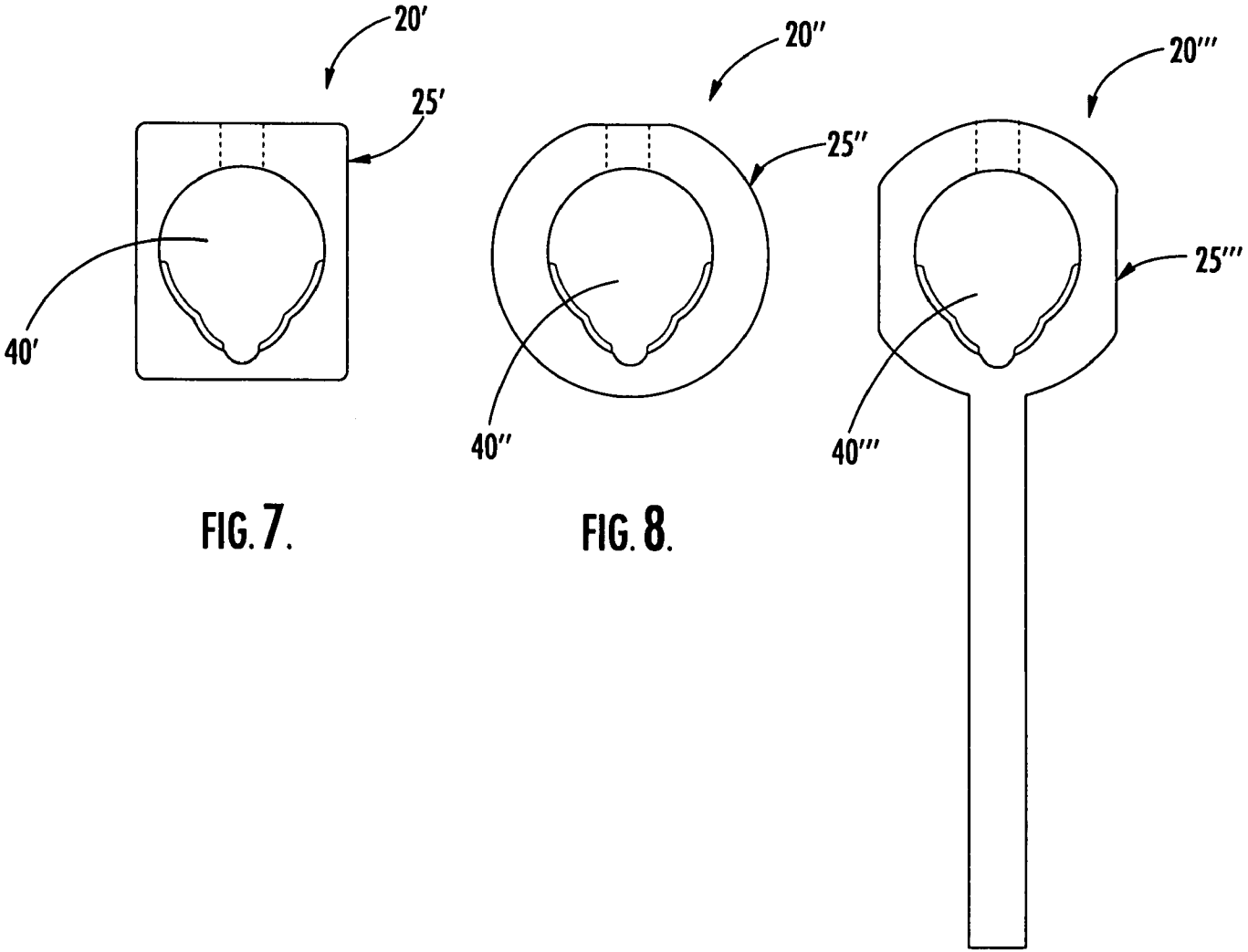
FIGS. 7–9 are end elevation views of other slip-fit electrical connector embodiments in accordance with the invention.

Referring now additionally to FIGS. 7–9 other variations of electrical connectors 20', 20" and 20'" are briefly explained. In these embodiments, the respective connector bodies 25', 25" and 25'" differ from one another; however, a similar multi-size transformer stud receiving passageway 40', 40" and 40'" is used in each embodiment. Although not shown for clarity, the connectors 20', 20" and 20'" also include conductor receiving passageways and associated fasteners as will be appreciated by those skilled in the art. Those of skill in the art will also recognize many other configurations of slip-fit transformer stud connectors may also similarly benefit from the multi-size transformer stud receiving passageway in accordance with the invention.

Figure 10:
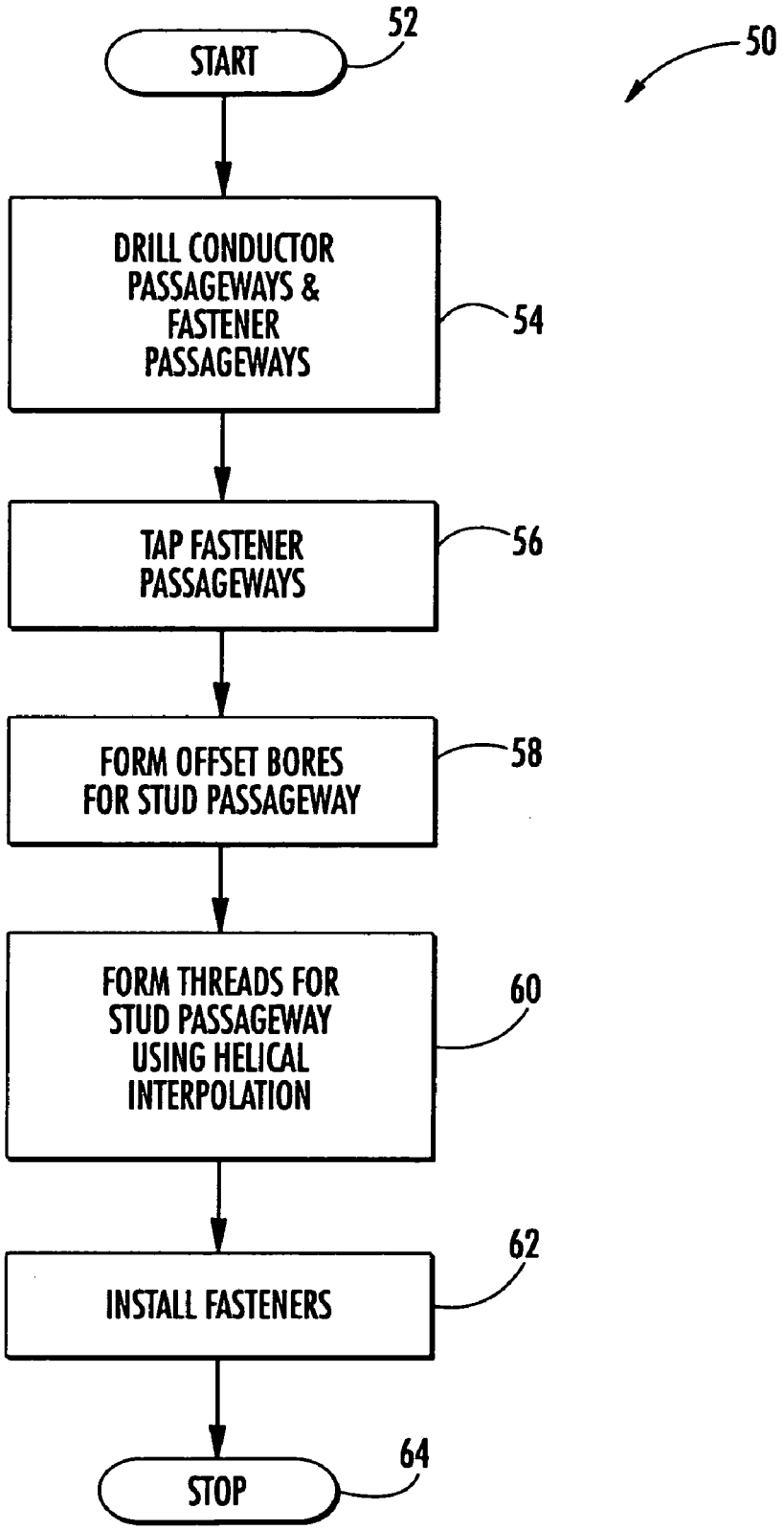
FIG. 10 is a flow chart for manufacturing methods for the slip-fit electrical connector according to the present invention.

Referring now additionally to the flow chart 50 of FIG. 10, method aspects of the invention are now described. From the start (Block 52), the conductor receiving passageways 26, and fastener receiving passageways 27, 31 are drilled into the body 25 of the electrical connector 20 (Block 54). The fastener receiving passageways 27, 31 are tapped to form threads therein at Block 56). The multi-size transformer stud receiving passageway 40 may be formed, such as by forming or drilling successively larger offset bores (Block 58). Alternately, the stud receiving passageway 40 could be formed by CNC machining. In addition, the threads may be formed for the threaded landings 42, 43 using helical interpolation at Block 60. For helical interpolation, a thread milling machine causes two axes to move in a circular path as a third axis moves in a linear path as will be appreciated by those skilled in the art. Helical interpolation permits threading only those portions of the interior of the passageway 40 desired, and, also permits threads to be formed on non-round surfaces as will also be appreciated by those skilled in the art. The fasteners 28, 32 are added to the connector 20 at Block 62 before stopping (Block 64).

Of course the order of the recited steps may be somewhat different in other embodiments. In addition, helical interpolation may not be used to make the threaded surfaces, and, rather, other conventional thread forming techniques may be used as will be appreciated by those skilled in the art. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

What is claimed is:

1. A slip-fit electrical connector compatible with different size threaded transformer studs and comprising:

a body having a plurality of transverse conductor receiving passageways therein, and a plurality of conductor fastener receiving passageways therein intersecting respective transverse conductor receiving passageways;

a plurality of conductor fasteners in respective conductor receiving passageways;

said body also having a multi-size transformer stud receiving passageway extending inwardly from an end thereof, and at least one stud fastener receiving passageway therein intersecting the multi-size transformer stud receiving passageway; and at least one stud fastener in the at least one stud fastener receiving passageway;

the multi-size transformer stud receiving passageway being defined by a smooth arcuate bottom, and a plurality of successively larger threaded stud landings with a lowermost threaded stud landing being bifurcated by the smooth arcuate bottom, and each successive threaded stud landing being bifurcated by a prior threaded stud landing, the threaded stud landings being compatible with different size threaded transformer studs.

2. A slip-fit electrical connector according to claim 1 wherein each threaded stud landing has a respective different radius of curvature.

3. A slip-fit electrical connector according to claim 1 wherein each threaded stud landing has an oversized radius of curvature for each respective different size transformer stud.

4. A slip-fit electrical connector according to claim 1 wherein the multi-size transformer stud receiving passageway further comprises an arcuate top merged with an uppermost threaded stud landing and connected to the at least one stud fastener receiving passageway.

5. A slip-fit electrical connector according to claim 4 wherein the arcuate top has a smooth surface.

6. A slip-fit electrical connector according to claim 4 wherein the arcuate top has a first radius of curvature.

7. A slip-fit electrical connector according to claim 1 wherein the smooth arcuate bottom has a second radius of curvature.

8. A slip-fit electrical connector according to claim 1 wherein the plurality of threaded stud landings are two in number.

9. A slip-fit electrical connector according to claim 1 wherein said body has a generally rectangular shape.

10. A slip-fit electrical connector according to claim 1 wherein said body comprises first and second generally rectangular elongate portions connected in an offset arrangement.

11. A slip-fit electrical connector according to claim 1 wherein said body comprises aluminum.

12. A slip-fit electrical connector compatible with different size threaded transformer studs and comprising:

a body having a plurality of transverse conductor receiving passageways therein, and a plurality of conductor fastener receiving passageways therein intersecting respective transverse conductor receiving passageways;

a plurality of conductor fasteners in respective conductor receiving passageways;

said body also having a multi-size transformer stud receiving passageway extending inwardly from an end thereof, and at least one stud fastener receiving passageway therein intersecting the multi-size transformer stud receiving passageway; and at least one stud fastener in the at least one stud fastener receiving passageway;

the multi-size transformer stud receiving passageway being defined by a smooth arcuate bottom, a plurality of successively larger threaded stud landings with a lowermost threaded stud landing being bifurcated by the arcuate bottom, and a smooth arcuate top merged with an uppermost threaded stud landing and connected to the at least one stud fastener receiving passageway, each successive threaded stud landing being bifurcated by a prior threaded stud landing, and the threaded stud landings each having a respective different radius of curvature.

13. A slip-fit electrical connector according to claim 12 wherein each threaded stud landing has an oversized radius of curvature for each respective different size transformer stud.

14. A slip-fit electrical connector according to claim 12 wherein the plurality of threaded stud landings are two in number.

15. A slip-fit electrical connector according to claim 12 wherein said body has a generally rectangular shape.

16. A slip-fit electrical connector according to claim 12 wherein said body comprises first and second generally rectangular elongate portions connected in an offset arrangement.

17. A slip-fit electrical connector compatible with different size threaded transformer studs and comprising:

a body having a plurality of transverse conductor receiving passageways therein, and a plurality of conductor fastener receiving passageways therein intersecting respective transverse conductor receiving passageways;

said body also having a multi-size transformer stud receiving passageway extending inwardly from an end thereof, and at least one stud fastener receiving passageway therein intersecting the multi-size transformer stud receiving passageway; and the multi-size transformer stud receiving passageway being defined by an unthreaded arcuate bottom, and a plurality of successively larger threaded stud landings with a lowermost threaded stud landing being bifurcated by the unthreaded arcuate bottom, and each successive threaded stud landing being bifurcated by a prior threaded stud landing.

18. A slip-fit electrical connector according to claim 17 wherein each threaded stud landing has a respective different radius of curvature.

19. A slip-fit electrical connector according to claim 17 wherein each threaded stud landing has an oversized radius of curvature for each respective different size transformer stud.

20. A slip-fit electrical connector according to claim 17 wherein the multi-size transformer stud receiving passageway further comprises an arcuate top merged with an uppermost threaded stud landing and connected to the at least one stud fastener receiving passageway.

21. A slip-fit electrical connector according to claim 17 wherein the arcuate top has a smooth surface and a first radius of curvature; and wherein the unthreaded arcuate bottom has a smooth surface and a second radius of curvature.

22. A slip-fit electrical connector according to claim 17 wherein the plurality of threaded stud landings are two in number.

23. A slip-fit electrical connector according to claim 17 wherein said body has a generally rectangular shape.

24. A slip-fit electrical connector according to claim 17 wherein said body comprises first and second generally rectangular elongate portions connected in an offset arrangement.

25. A method for making a slip-fit electrical connector compatible with different size threaded transformer studs and comprising:

forming, in a body, a plurality of transverse conductor receiving passageways, and a plurality of conductor fastener receiving passageways intersecting respective transverse conductor receiving passageways; and forming, in the body, a multi-size transformer stud receiving passageway extending inwardly from an end thereof, and at least one stud fastener receiving passageway therein intersecting the multi-size transformer stud receiving passageway, the multi-size transformer stud receiving passageway being defined by an unthreaded arcuate bottom, and a plurality of successively larger threaded stud landings with a lowermost threaded stud landing being bifurcated by the unthreaded arcuate bottom, and each successive threaded stud landing being bifurcated by a prior threaded stud landing.

26. A method according to claim 25 wherein forming the multi-size transformer stud receiving passageway comprises:

drilling a plurality of successively larger bores vertically offset from one another; and forming threaded surfaces for the threaded stud landings by helical interpolation.

27. A method according to claim 25 further comprising positioning conductor fasteners in the conductor receiving passageways, and at least one stud fastener in the at least one stud fastener receiving passageway.

28. A method according to claim 25 wherein each threaded stud landing has a respective different radius of curvature.

29. A method according to claim 25 wherein each threaded stud landing has an oversized radius of curvature for each respective different size transformer stud.

30. A method according to claim 25 wherein the transformer stud receiving passageway further comprises an arcuate top merged with an uppermost threaded stud landing and connected to the at least one stud fastener receiving passageway.

31. A method according to claim 25 wherein the arcuate top has a smooth surface and a first radius of curvature; and wherein the unthreaded arcuate bottom has a smooth surface and a second radius of curvature.

32. A method according to claim 25 wherein the plurality of threaded stud landings are two in number.

33. A method for making a slip-fit electrical connector for a threaded transformer stud comprising:

forming, in a body, a plurality of transverse conductor receiving passageways, and a plurality of conductor fastener receiving passageways intersecting respective transverse conductor receiving passageways;

forming, in the body, a transformer stud receiving passageway extending longitudinally inwardly from an end thereof at least one bore and forming at least one set of threads along surfaces of the at least one bore using helical interpolation; and forming, in the body, at least one stud fastener receiving passageway intersecting the transformer stud receiving passageway.

34. A method according to claim 33 further comprising positioning conductor fasteners in the conductor receiving passageways, and at least one stud fastener in the at least one stud fastener receiving passageway.

35. A method according to claim 33 wherein the transformer stud receiving passageway is a multi-size transformer stud receiving passageway defined by an arcuate bottom, and a plurality of successively larger threaded stud landings with a lowermost threaded stud landing being bifurcated by the arcuate bottom, and each successive threaded stud landing being bifurcated by a prior threaded stud landing.

36. A method according to claim 35 wherein each threaded stud landing has a respective different radius of curvature.

* * * * *